United States Patent [19]

Gallin

[11] 4,370,756

[45] Feb. 1, 1983

[54] MULTIPLE PLY GARRISON CAP

[75] Inventor: Paul G. Gallin, Bronxville, N.Y.

[73] Assignee: Art Cap Company, Inc., New York, N.Y.

[21] Appl. No.: 202,012

[22] Filed: Oct. 29, 1980

[51] Int. Cl.[3] ..... A42B 1/04

[52] U.S. Cl. ..... 2/195; 2/200

[58] Field of Search ..... 2/195, 200, 181, 184, 2/197, 192, 194; 428/284

[56] References Cited

U.S. PATENT DOCUMENTS 1,816,346 7/1931 Silverstein ..... 2/195

2,748,396 6/1956 Lipschutz et al. ..... 2/195

4,329,386 5/1982 Samowich ..... 428/284 X

*Primary Examiner*—Peter P. Nerbun

*Attorney, Agent, or Firm*—Curtis Ailes

[57] ABSTRACT

A garrison cap having a crown portion and an outer band portion attached together at the lower margin of the crown portion. Both the crown portion and the outer band portion are composed of a multiple ply laminated material including an outer ply of textile suiting material and an inner ply of nylon tricot textile material with the two textile materials being securely bonded together by a polyester foam.

7 Claims, 3 Drawing Figures

MULTIPLE PLY GARRISON CAP

This invention relates to a soft military cap for use with military uniforms of the type commonly referred to as a garrison cap, an overseas cap, or a flight cap.

Military caps of the above description are very popular in the armed services because they are usually very comfortable and light in weight and neat in appearance. However, such caps are vulnerable to soiling and are easily mussed, so that they need frequent cleaning and pressing.

In order to provide a cap which holds its shape and thus presents a neat appearance, it is common for the customer to specify that the cap must have a leather sweatband which helps to determine and hold the shape of the cap. The leather sweatband also adds to the "body" of the cap and helps to hold it in place on the head. Even so, a cap which would hold its shape even better is greatly desired.

Accordingly, it is an important object of the present invention to provide a garrison cap which holds its shape and maintains its appearance, and does not become mussed looking.

One problem with providing a leather sweatband in a garrison cap is that the leather sweatband component is not washable or dry-cleanable.

Accordingly, it is a further object of the present invention to provide a garrison cap which does not require a leather sweatband and which can be washed or dry-cleaned in order to conveniently remove the soil therefrom, and which yet maintains its shape and appearance without the leather sweatband.

In carrying out the objects of the invention, there is provided a multiple ply garrison cap comprising a crown portion and an outer band portion extending upwardly from the lower margin of said crown portion and surrounding the lower parts of said crown portion and attached thereto, both said crown portion and said outer band portion comprising a muliple ply laminated material including an outer ply of textile suiting material with the two textile materials being securely bonded together by means of a thin layer of polyester foam.

Further objects and advantages of the invention will be apparent from the following description and the accompanying drawings.

DETAILED DESCRIPTION OF THE PREFERRED EMBODIMENT

Figure 1:
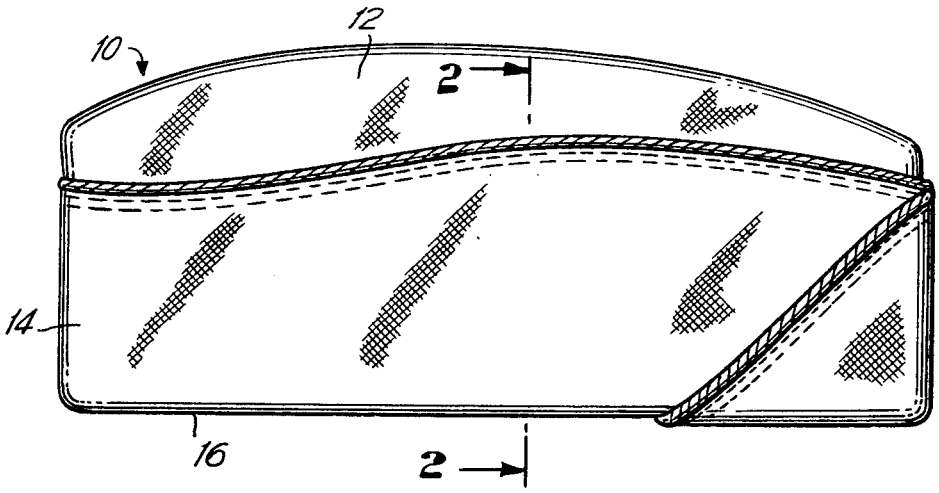
FIG. 1 is a side view of a garrison cap in accordance with the present invention.

Referring more particularly to FIG. 1, the cap of the invention is illustrated as a whole at 10. The cap includes a crown portion 12 and an outer band portion 14 extending upwardly from the lower margin of the crown portion at 16 and surrounding the lower parts of the crown portion and attached to the crown portion.

Figure 2:
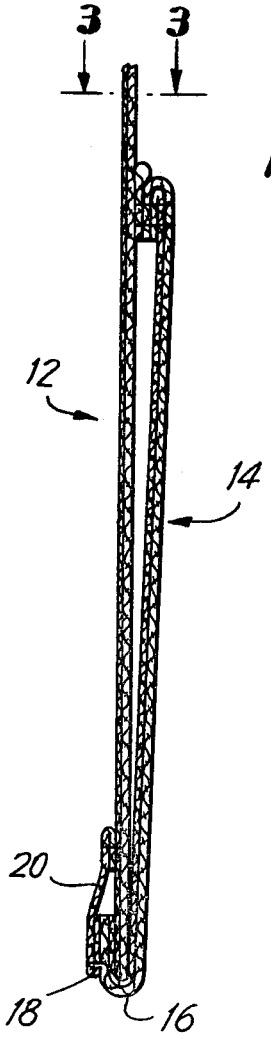
FIG. 2 is a partial sectional view of a portion of one side of the cap taken at section 2—2 of FIG. 1 to show the construction of the cap.

FIG. 2 is a sectional view through a portion of the cap as indicated at section 2—2 in FIG. 1. FIG. 2 particularly illustrates how the outer band portion 14 is arranged with respect to the crown portion 12, although only a part of the crown portion 12 is illustrated in FIG. 2. As illustrated in FIG. 2, the outer band portion 14 is stitched at 18 to the crown portion at a seam at the inside marginal edge of the crown portion 12. The outer band portion is then folded around the outside of the marginal edge of the crown portion 12 to thereby hide the seam.

As also illustrated in FIG. 2, a sweat band 20 is provided and attached at the inside marginal edge and over the seam. The sweatband 20 covers the edge of the band which is folded up inside the lower marginal edge of the crown portion 12.

The sweatband 20 is preferably composed of cloth as contrasted to the usual practice of using a leather sweatband. Furthermore, the sweatband and the entire cap are preferably washable.

Figure 3:
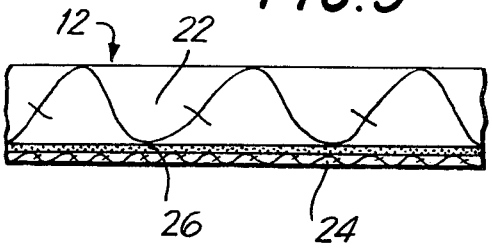
FIG. 3 is a greatly enlarged sectional view taken at section 3—3 of FIG. 2 which illustrates the construction of the multiple ply laminated material of which the cap is formed.

As also illustrated in FIG. 2, and especially in FIG. 3, both the crown portion and the band portion of the cap are composed of a multiple ply laminated material.

FIG. 3 is a greatly enlarged cross section of the material of the cap taken at section 3—3 in FIG. 2 to illustrate the multiple ply construction. The material includes an outer ply 22 of textile suiting material and an inner ply 24 of nylon tricot textile material, with the two textile materials being securely bonded together by means of a thin layer 26 of a polyester foam. While the polyester foam is filled with bubbles and is very light in structure, it has been found to be very effective as an adhesive. Furthermore, although not illustrated in the drawing, the polyester foam enters the interstices of the other materials, particularly the interstices of the nylon tricot liner 24 so that the foam adds very little to the overall thickness of the laminated structure.

In a typical construction according to the invention, the outer ply 22 of suiting material may be typically as thick as thirty thousandths of an inch, or as thin as fifteen thousandths of an inch. The nylon tricot liner 22, in combination with the foam layer 26 may be only seven thousandths of an inch in thickness.

It will be understood that it is within the scope of the invention to provide a greater thickness in the laminated structure in order to provide even greater stiffness, if desired. However, the above described structure having the aforementioned proportions is preferred.

One of the biggest advantages of the construction in accordance with the invention is that the cap is washable and dry-cleanable. The inclusion of the foam layer 26 does not impair washability or dry-cleanability. Furthermore, the laminated construction, in which the liner 24 is securely bonded by the foam layer 26 to the outer suiting layer 22 adds considerable body to the combined material and provides a cap which holds its shape very well despite the lack of a leather sweatband. Furthermore, it has been found that the laminated material maintains its shape so well that very little pressing is required even after the cap has been washed or dry-cleaned.

It has been found that, if the leather sweatband is simply omitted in order to provide for washability or dry-cleanability, without incorporating the laminated structure of the present invention, washing or dry-cleaning the cap substantially impairs the shape holding ability of the cap. Thus, the washing or dry-cleaning of the cap removes the "sizing" from the material, and it has been found that even if the cap is pressed, it will not hold its shape very well. By contrast, by employing the present invention, the cap does hold its shape and body very well after washing or dry-cleaning, even though the sizing may be removed from the outer suiting layer 22 by those processes. Furthermore, some such caps are provided with a gusset in the top of the cap to provide for expansion of the crown when the cap is worn. With center gusset caps, when constructed in accordance with the present invention with the composite laminated structure, it has been found that the center gusset snaps back into place after the cap is washed or dry-cleaned, whereas such a restoration of the shape is not available with conventional cap construction after washing or dry-cleaning.

The outer ply of textile suiting material may have any one of various compositions, including blends of polyester and wool, such as 60% polyester and 40% wool, or blends of polyester and cotton, such as 50% of each, or the outer ply may consist of 100% wool. Various known suiting materials may be used which are referred to variously as twill, gabardine, and tropical.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. A multiple ply garrison cap comprising a crown portion and an outer band portion extending upwardly from the lower margin of said crown portion and surrounding the lower parts of said crown portion and attached thereto, both said crown portion and said band portion comprising a multiple ply laminated material including an outer ply of textile suiting material and an inner ply of nylon tricot textile material with the two textile materials being securely bonded together by means of a thin layer of polyester foam.

2. The cap of claim 1 wherein said outer band portion is stitched to said crown portion at a seam at the inside marginal edge of said crown portion and said outer band portion is then folded around the outside of said marginal edge to hide said seam, and wherein a sweatband is provided and attached at said inside marginal edge over said seam.

3. A cap as claimed in claim 2 wherein said sweatband is a textile material.

4. A cap as claimed in claim 3 wherein the entire cap is washable.

5. A cap as claimed in claim 1 wherein said outer ply of textile suiting material is comprised of 50% polyester and 50% cotton.

6. A cap as claimed in claim 1 wherein said outer ply of textile suiting material is comprised of 60% polyester and 40% wool.

7. A cap as claimed in claim 1 wherein said outer ply of textile suiting material is comprised of 100% wool.

* * * * *